US008050594B2

(12) United States Patent
Yuge

(10) Patent No.: US 8,050,594 B2
(45) Date of Patent: Nov. 1, 2011

(54) IMAGE FORMING APPARATUS

(75) Inventor: Keiji Yuge, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 222 days.

(21) Appl. No.: 12/371,998

(22) Filed: Feb. 17, 2009

(65) Prior Publication Data

US 2009/0208251 A1 Aug. 20, 2009

Related U.S. Application Data

(60) Provisional application No. 61/029,863, filed on Feb. 19, 2008.

(51) Int. Cl.
*G03G 15/00* (2006.01)

(52) U.S. Cl. ..... 399/167

(58) Field of Classification Search ..... 399/50, 399/66, 115, 121, 159, 167
See application file for complete search history.

(56) References Cited

U.S. PATENT DOCUMENTS

| | | | | |
|---|---|---|---|---|
| 5,689,774 | A * | 11/1997 | Shishido et al. | 399/111 |
| 7,274,896 | B2 * | 9/2007 | Kawai et al. | 399/111 |
| 2008/0223173 | A1 * | 9/2008 | Ishikawa | 74/640 |
| 2009/0317734 | A1 * | 12/2009 | Takeda | 430/60 |

FOREIGN PATENT DOCUMENTS

| | | |
|---|---|---|
| JP | 06-003924 | 1/1994 |
| JP | 06-051656 | 2/1994 |

* cited by examiner

*Primary Examiner* — Hoan Tran
(74) *Attorney, Agent, or Firm* — Turocy & Watson, LLP

(57) ABSTRACT

A conductive drum flange is provided in a cylindrical member of a photoconductive drum. A first gear is formed on an outer circumferential surface of the drum flange. A nonconductive gear member is provided in a shaft member of a transfer roller. A second gear to which driving force is transmitted from the first gear is formed on an outer circumferential surface of the gear member. A groove is formed in at least one of two sides of the gear member. A distance for insulation along the side is increased by groove walls of the groove.

21 Claims, 7 Drawing Sheets

IMAGE FORMING APPARATUS

CROSS-REFERENCE TO RELATED APPLICATION

The present application claims priority under 35 U.S.C 119 to U.S. Provisional Application Ser. No. 61/029,863, entitled IMAGE FORMING APPARATUS, to Yuge, filed on Feb. 19, 2008, the entire disclosure of which are incorporated herein by reference.

TECHNICAL FIELD

The present invention relates to image forming apparatuses such as an MFP (Multi Function Peripheral) and a printer, and, more particularly to an image forming apparatus including a photoconductive drum and a device that comes into contact with a semiconductor layer on the drum and imparts charges to this layer.

BACKGROUND

A photoconductive drum has, on the surface thereof, a photosemiconductor layer on which an electrostatic latent image is formed. Static electricity on the photoconductive drum is grounded via drum flanges press-fit in both ends of the drum.

For one photoconductive drum, the drum flanges are used in two places at both the ends.

Unnecessary charges are grounded via at least one of the drum flanges. Usually, a metal shaft for grounding is inserted into the drum flange used for the grounding.

A coupling is provided in the metal shaft. The coupling has a coupling projection. A coupling recess is provided in the center of the drum flange. The coupling recess fits with the coupling projection.

A coupling structure is formed by the coupling recess and the coupling projection. The photoconductive drum rotates according to the transmission of driving force from the coupling projection to the coupling recess.

Alternatively, as another coupling structure for transmitting the driving force, a structure in which a gear provided in an outer circumference of the drum flange is meshed with another gear may be used. The photoconductive drum rotates according to the transmission of the driving force via the two gears.

The drum flange grounds charges of the photoconductive drum. The drum flange is obtained by 1/ combining a sheet metal with a structure molded from a nonconductive material such as resin or 2/ being molded from a conductive material.

A charging roller and a transfer roller impart charges to a photoconductive member. In an apparatus including the charging roller and the transfer roller, the drum flange of 1/ above is used. Driving force is transmitted to the charging roller and the transfer roller by the gear of the nonconductive resin provided in the outer circumference of the drum flange.

High bias voltage is applied to the charging roller and the transfer roller. A distance for insulation along surfaces is required to be secured between the charging roller and the photoconductive drum. The distance for insulation is required to be secured between the transfer roller and the photoconductive drum as well.

In the past, there is proposed a charge removing device that makes it possible to prevent a leak of an electric current from a conductive core of a charge removing roller to a photoconductive member (JP-A-06-3924).

JP-A-06-3924 discloses a technique for providing insulating members in rings of the conductive core and the photoconductive member and securing a distance along surfaces between the conductive core and the photoconductive member.

There is also proposed an image forming apparatus that makes it possible to prevent a leak due to a distance along surfaces (JP-06-51656).

JP-06-51656 discloses a technique for increasing the distance along the surfaces by forming small-diameter sections at both ends of a transfer roller and providing, in circumferential surfaces of the small-diameter sections, four grooves orthogonal to an axis of the transfer roller.

However, the drum flange of 1/ above is obtained by combining the nonconductive material having the resin gear and the sheet metal. Therefore, in the drum flange of 1/ above, it is necessary to bring a metal member into contact with the shaft in order to ground the photoconductive drum.

In the drum flange of 1/ above, it is necessary to additionally provide a grounding leaf spring and the like. In this case, the number of components further increases and the wear of the shaft is caused by the grounding leaf spring.

When the grounding drum flange of 2/ above is used, if the material of the drum flange is a metal material such as aluminum, the wear of the shaft is caused by friction of the two kinds of metal. In particular, if a gear structure is provided in the outer circumference of the drum flange, it is difficult to mold the gear.

On the other hand, if the material of the grounding drum flange of 2/ is conductive resin, there is a risk of a leak. This is because high bias voltage is applied between the photoconductive drum and the transfer roller.

If the gear structure is provided in the outer circumference of the drum flange, there is a risk that, when the driving force is transmitted from the photoconductive drum to the transfer roller, the distance for insulation along the surfaces between the drum flange and the shaft of the transfer roller is reduced.

A risk of a leak between the photoconductive drum and the charging roller is the same as the risk of the leak between the photoconductive drum and the transfer roller.

As a structure for transmitting the driving force from the photoconductive drum to the charging roller or the transfer roller, a conductive material may be used for one drum flange and a nonconductive material may be used for the other drum flange.

It is also possible to provide a gear on an outer circumferential surface of the nonconductive drum flange. In this case, one drum flange is driven for grounding of the photoconductive drum as well. The other drum flange drives the charging roller and the transfer roller.

However, if functions are divided to the respective flanges, the thicknesses of the drum flanges increase. If the two drum flanges are combined with the photoconductive drum, the total length in a longitudinal direction of the photoconductive drum increases, leading to an increase in size of the apparatus.

SUMMARY

It is an object of the present invention to provide an image forming apparatus that includes a conductive drum flange and forms an image on a recording medium.

In an aspect of the present invention, an image forming apparatus includes: a photoconductive drum including a conductive cylindrical member and a photoconductive layer on an outer circumferential surface of the cylindrical member; a transfer roller including a conductive shaft member that has an axis parallel to an axis of the cylindrical member of the photoconductive drum, and a contact charging member that is provided in the outward direction of the shaft member and comes into contact with a developer image on the photoconductive layer to transfer the developer image onto a recording medium; a conductive drum flange that is provided at one end of the cylindrical member of the photoconductive drum, and on an outer circumferential surface of which plural first gear teeth are formed; a driving unit that drives to rotate the drum flange; and a nonconductive gear member that is provided in the shaft member of the transfer roller to be opposed to the drum flange and has an outer circumferential surface on which plural second gear teeth, to which driving force is transmitted from the plural first gear teeth of the drum flange, are formed, a bearing surface that rotatably supports the shaft member, and two sides orthogonal to an axial direction of the shaft member and on at least one side of which a groove is formed. A distance for insulation along the side is increased by groove walls of the groove.

DESCRIPTION OF THE DRAWINGS

For a fuller understanding of the present invention, reference should be made to the following detailed description thereof taken in conjunction with the accompanying drawings wherein.

DETAILED DESCRIPTION

Figure 1:
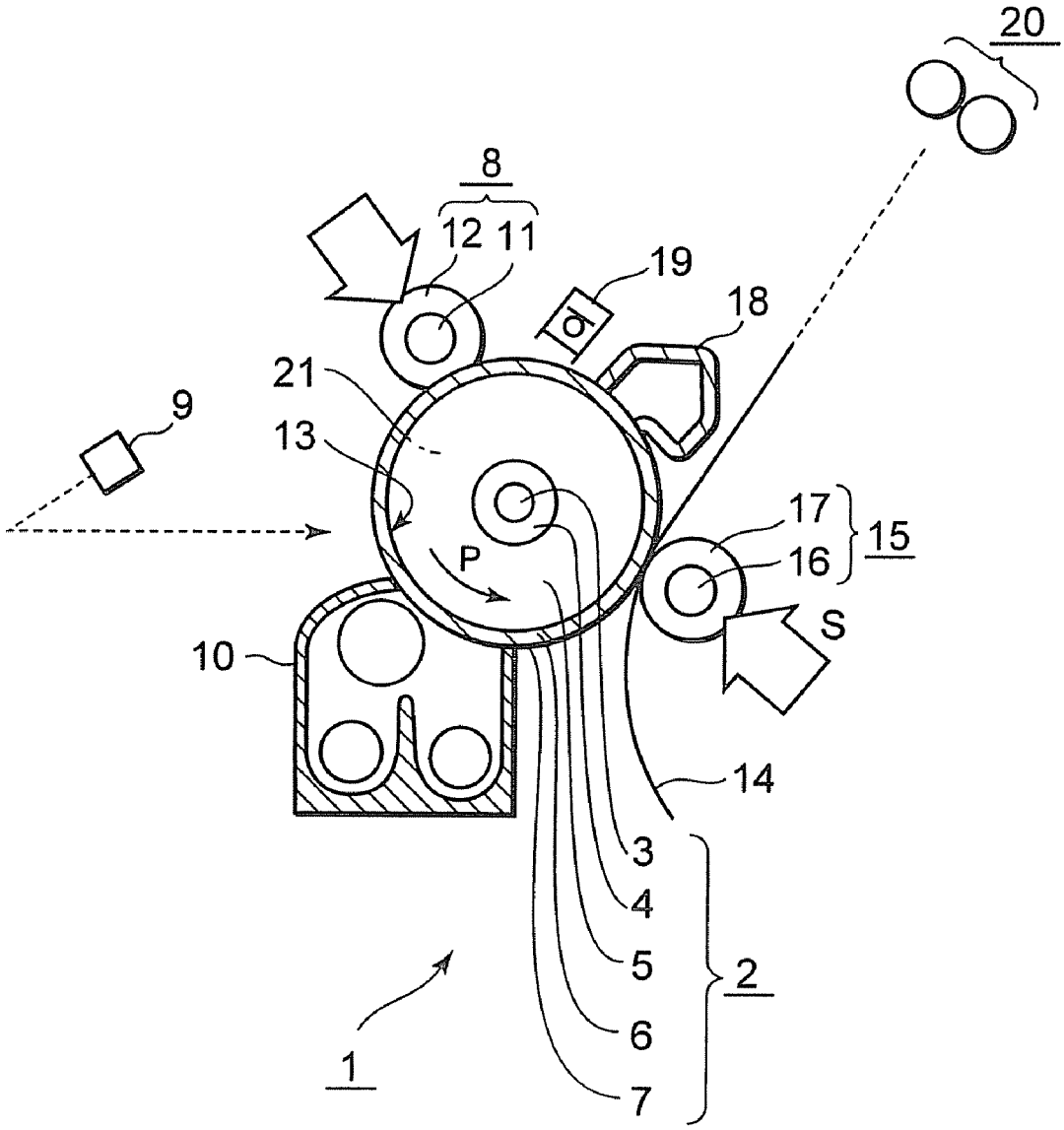
FIG. 1 is a schematic diagram of a longitudinal section of an image forming unit.

Throughout this description, the embodiments and examples shown should be considered as exemplars, rather than limitations on the apparatus and methods of the present invention.

An image forming apparatus according to an embodiment of the present invention is explained in detail below with reference to the accompanying drawings as examples. In the drawings, the same components are denoted by the same reference numerals and signs and redundant explanation of the components is omitted.

The image forming apparatus according to the embodiment is an MFP. The MFP has an image forming unit. FIG. 1 is a schematic diagram of a longitudinal section of an image forming unit. An image forming unit 1 includes a photoconductive drum 2 that rotates in an arrow "p" direction.

The photoconductive drum 2 includes a shaft 3, a coupling 4, a drum flange 5, another drum flange 21, an aluminum pipe 6, and a semiconductor layer 7 on an outer circumferential surface of the aluminum pipe 6.

The shaft 3 is made of metal. The shaft 3 is electrically connected to a housing of the MFP. The housing is grounded.

The shaft 3 is driven to rotate by a not-shown motor. The coupling 4 having electrical conductivity is fixed to the shaft 3. The drum flange 5 is fixed to the coupling 4. The aluminum pipe 6 is a conductive cylindrical member.

The drum flange 5 is fit in one end of the aluminum pipe 6. A material of the drum flange 5 is conductive synthetic resin. The drum flange 21 is fit in the other end of the aluminum pipe 6. A material of the drum flange 21 is nonconductive synthetic resin.

When the shaft 3 rotates, the rotational force of the shaft 3 is transmitted to the drum flange 5 via the coupling 4. The aluminum pipe 6 rotates together with the drum flange 5.

The semiconductor layer 7 is a photoconductive layer. A laser beam is irradiated on the semiconductor layer 7. The semiconductor layer 7 is grounded to the shaft 3 via the drum flange 5 and the coupling 4.

A charging roller 8 is provided around the photoconductive drum 2. The image forming unit 1 includes a laser oscillator 9 and a developing device 10 in order from the charging roller 8 along the drum rotating direction "p".

The charging roller 8 includes a shaft 11 that has an axis parallel to an axis of the shaft 3 of the photoconductive drum 2 and an elastic layer member 12 that is provided in the outward direction of the shaft 11 and comes into contact with the semiconductor layer 7 to charge the semiconductor layer 7.

The shaft 11 is a shaft member of metal. Both ends of the shaft 11 are rotatably supported by bearing members in the housing of the MFP. The shaft 11 is driven to rotate by a not-shown motor or driving-force transmitting member. The elastic layer member 12 is a contact charging member and is made of mainly a conductive elastic material.

The laser oscillator 9 emits a laser beam modulated on the basis of image information. The laser beam is irradiated on an irradiation position 13 on the semiconductor layer 7 by a not-shown mirror or the like.

The developing device 10 supplies a toner to an electrostatic latent image formed on the semiconductor layer 7 by the laser beam to thereby visualize the image.

A transfer roller 15 that transfers a developed toner image on the photoconductive drum 2 onto paper 14 is also provided around the photoconductive drum 2. The paper 14 is a recording medium.

The transfer roller 15 includes a shaft 16 that has an axis parallel to the axis of the shaft 3 of the photoconductive drum 2 and an elastic layer member 17 that is provided in the outward direction of the shaft 16 and comes into contact with the toner image on the semiconductor layer 7 to transfer the toner image onto the paper 14.

The shaft 16 is a metal shaft member. Both ends of the shaft 16 are rotatably supported by bearing mechanisms. The bearing mechanisms include motors and driving-force transmitting members.

The bearing mechanisms are movably attached to the housing of the MFP. The bearing mechanisms move in a state in which the axis of the shaft 3 and the axis of the shaft 16 are kept parallel.

Force in a direction toward an outer circumferential surface of the photoconductive drum 2 is applied to the bearing mechanisms by springs or the like. The transfer roller 15 is subjected to a load in an arrow "s" direction by the applied force.

The elastic layer member 17 is a contact charging member. An elastic material such as urethane rubber is mainly used for the elastic layer member 17.

A cleaner 18 that removes a toner on the photoconductive drum 2 and a charge removing lamp 19 for removing charges on the photoconductive drum 2 are further provided around the photoconductive drum 2.

A fixing device 20 is provided in a direction in which the paper 14 is conveyed. The fixing device 20 fixes the toner image on the paper 14 peeled off from the photoconductive drum 2. The paper 14 subjected to the fixing is discharged.

In the photoconductive drum 2, a pair of positive and negative charges are generated in the semiconductor layer 7 by the irradiation of the laser beam on the semiconductor layer 7. The generated positive charge eliminates a negative charge in the layer. The generated negative charge is grounded via the shaft 3.

Figure 2:
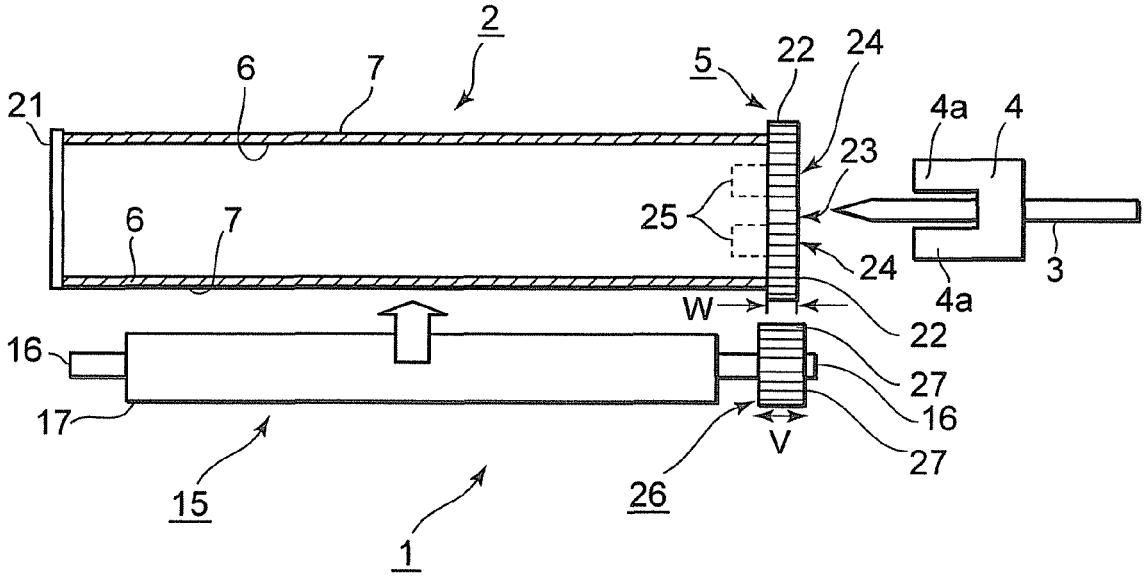
FIG. 2 is a diagram of a structure in which driving force is transmitted from a photoconductive drum to a transfer roller.

FIG. 2 is a diagram of a structure in which driving force is transmitted from the photoconductive drum 2 to the transfer roller 15. Reference numerals in FIG. 2 same as those described above denote components same as those shown in FIG. 1.

An outer circumference of the drum flange 5 is fit in an inner wall at the right end of the aluminum pipe 6.

A region on the left side of an entire region of an outer circumferential surface of the drum flange 5 is fixed to an inner circumferential surface of the aluminum pipe 6. Plural gear teeth 22 (first gear teeth) are formed in a region on the right side of the entire region of the outer circumferential surface.

The respective gear teeth 22 are external teeth. A gear section is formed by the plural gear teeth 22 arranged along the outer circumferential surface.

Figure 3:
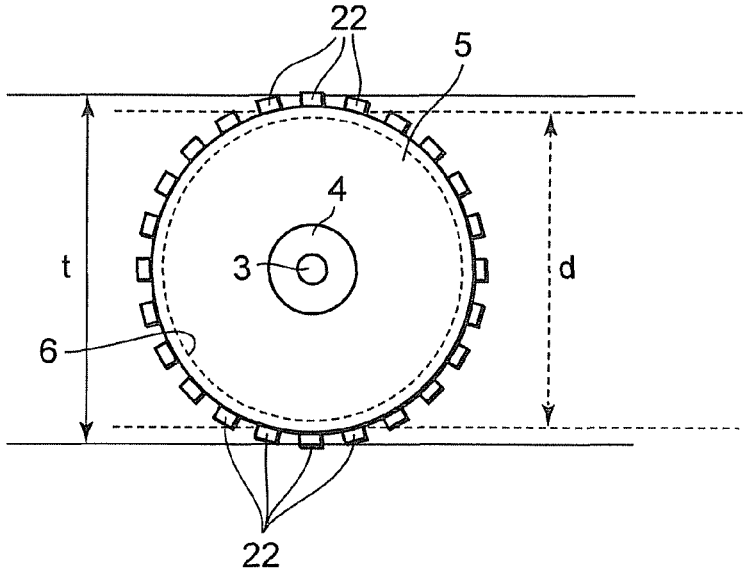
FIG. 3 is a side view of a drum flange.

FIG. 3 is a side view of the drum flange 5. A diameter "t" of a teeth tip circle of the gear section is larger than an outer diameter "d" of the aluminum pipe 6. A maximum diameter of the drum flange 5 including the height of the gear teeth 22 is larger than the outer diameter "d" of the aluminum pipe 6.

As shown in FIGS. 2 and 3, the drum flange 5 has the gear section and a fitting section that are integrally formed in an axial direction of the drum flange 5.

The gear section is a section that has the diameter "t" of the teeth tip circle larger than the outer diameter "d" of the aluminum pipe 6. The fitting section is a section that has a diameter substantially the same as a diameter of the inner wall of the aluminum pipe 6.

In FIG. 2, the shaft 3 is inserted through a center hole 23 of the drum flange 5. In the drum flange 5, two openings 24 are formed in positions different from the position of the center hole 23.

Two coupling recesses 25 are formed in the drum flange 5. Both the coupling recesses 25 are located in the inside of the aluminum pipe 6. End faces on the drum flange 5 side of the coupling recesses 25 are substantially the same as the openings 24. The two coupling recesses 25 having a cylindrical shape are formed integrally with the drum flange 5.

The coupling 4 imparts driving force to the drum flange 5. The coupling 4 has two coupling projections 4*a*. The coupling projections 4*a* are inserted into the coupling recesses 25, respectively.

The driving force of rotation from the shaft 3 applied to the coupling 4 is transmitted to the aluminum pipe 6 via the two coupling recesses 25.

Since the drum flange 5 made of conductive synthetic resin is used, both the reception of the driving force of rotation by the photoconductive drum 2 and the grounding of the photoconductive drum 2 are realized.

A nonconductive gear member 26 is attached to the shaft 16 of the transfer roller 15. Plural gear teeth 27 (second gear teeth) are formed on an outer circumferential surface of the gear member 26. The gear teeth 27 are also external teeth.

In a state in which the photoconductive drum 2 and the transfer roller 15 are set in the image forming unit 1, the gear member 26 of the transfer roller 15 and the drum flange 5 of the photoconductive drum 2 mesh with each other.

The driving force of rotation is transmitted from the gear teeth 22 to the gear teeth 27. The transfer roller 15 receives, via the gear member 26 and the drum flange 5, the driving force of rotation applied to the photoconductive drum 2.

Figure 4A:
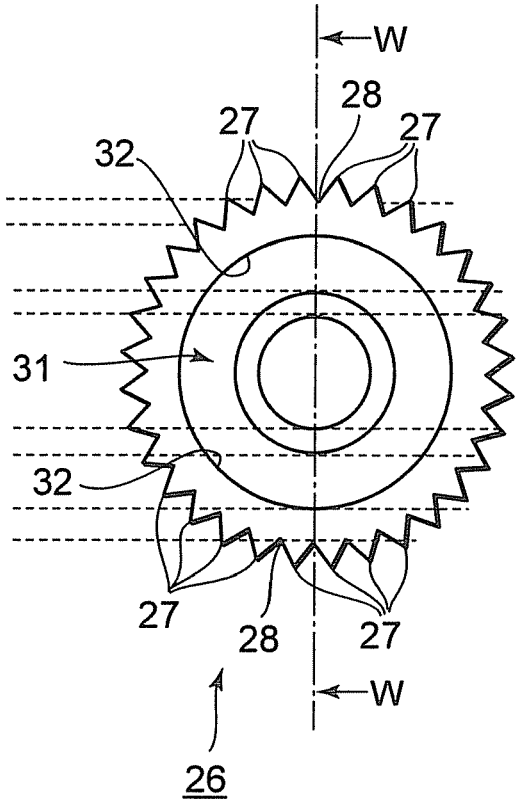
FIG. 4A is a side view of a gear member.
Figure 4B:
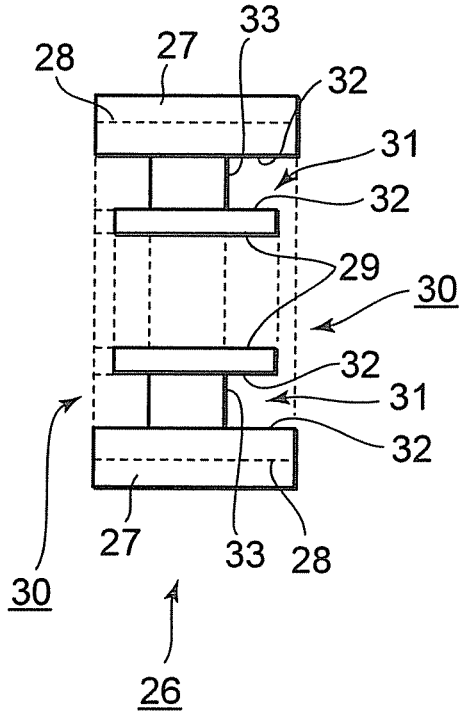
FIG. 4B is a schematic diagram of a longitudinal section along a WW line in FIG. 4A.

FIG. 4A is a side view of the gear member 26. FIG. 4B is a schematic diagram of a longitudinal section along a WW line in FIG. 4A. In FIGS. 4A and 4B, the same reference numerals denote the same components.

An outer surface of the gear member 26 includes an outer circumferential surface 28 on which the gear teeth 27 are formed, a bearing surface 29 that comes into contact with an outer circumferential surface of the shaft 16, and two sides 30 orthogonal to an axial direction of the gear member 26. The two sides 30 indicate flat surfaces, hollows, and shaft holes of outer sides of the gear member 26.

The outer circumferential surface 28 is a surface of a teeth bottom. The bearing surface 29 rotatably supports the shaft 16. Grooves 31 are formed in the two sides 30, respectively. Each of the grooves 31 is a circumferential groove.

The width in the radial direction of the gear member 26 is different depending on a position in the radial direction of the diameter of the gear member 26. The radial direction is an up to down direction in FIG. 4B.

The groove 31 has two groove walls 32 opposed to each other and a groove bottom 33. A distance for insulation along surfaces from the outer circumferential surface of the shaft 16 of the transfer roller 15 to teeth tips of the gear teeth 22 of the drum flange 5 is increased by the groove walls 32 and the groove bottom 33.

Figure 5:
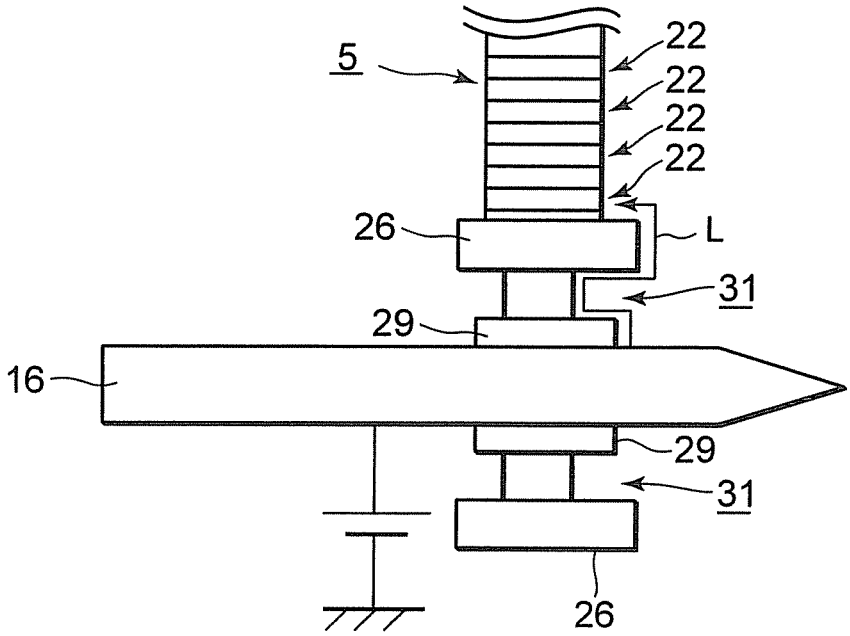
FIG. 5 is a diagram for explaining a distance for insulation along surfaces.

FIG. 5 is a diagram for explaining the distance for insulation along the surfaces. Reference sign L denotes an example of a path for insulation along the surfaces. The path L is a path having an electrically shortest distance for obtaining insulation between the drum flange 5 and the shaft 16.

The distance of the path L is a distance necessary for keeping insulation between the drum flange 5 and the shaft 16 when transfer voltage is applied between the drum flange 5 and the shaft 16.

The gear member 26 is nonconductive. The gear member 26 insulates the gear teeth 22 of the conductive drum flange 5 and the conductive shaft 16.

One end point of the path L is located near an edge of the bearing surface 29 on the outer circumferential surface of the shaft 16 on the gear teeth 22 side.

The other end point of the path L is located at the teeth tip of the gear teeth 22 or located on the teeth surface of the gear teeth 22. The surfaces of the shaft 16, the gear member 26, and the gear teeth 22 between the two end points are a part of the path L.

A distance for insulation along surfaces with the groove 31 is larger than a distance for insulation along surfaces without the groove 31. The distance for insulation along the surfaces is increased by the two groove walls 32 and the groove bottom 33.

As shown in FIG. 2, gear width V in the axial direction of the nonconductive gear member 26 is set larger than gear width W of the conductive gear teeth 22. An electrical path along wall surfaces of the groove walls 32 is extended. The distance for insulation along the surfaces is increased.

The above explanation refers to the structure in which the nonconductive gear member 26 is used between the photoconductive drum 2 and the transfer roller 15.

In the image forming unit 1, a not-shown nonconductive gear member substantially the same as the gear member 26 is used between the photoconductive drum 2 and the charging roller 8. This gear member is attached to the shaft 11 of the charging roller 8.

Plural external teeth, which are the second gear teeth, respectively, are formed on an outer circumferential surface of the gear member attached to the charging roller 8. The plural external teeth mesh with the plural gear teeth 22 of the drum flange 5. The charging roller 8 receives, via the gear teeth that mesh with each other, the driving force of rotation applied to the photoconductive drum 2.

The gear member attached to the shaft 11 of the charging roller 8 has an outer circumferential surface on which the plural gear teeth are formed, a bearing surface that supports the shaft 11, and two sides orthogonal to the axial direction of the shaft 11. Grooves are formed in both the sides. Each of the grooves is a circumferential groove.

Like the gear member 26, a distance for insulation along the surfaces from the outer circumferential surface of the shaft 11 to the teeth tips of the gear teeth 22 of the drum flange 5 is increased by grooves walls and a groove bottom of the groove.

In other words, two rollers are provided in the photoconductive drum 2. The charging roller 8 is provided in contact with the surface of the photoconductive drum 2. The transfer roller 15 is provided a very small space apart from the surface of the photoconductive drum 2.

Both the charging roller 8 and the transfer roller 15 have rotatably-supported conductive shafts and layers of a conductive rubber material provided on circumferential surfaces of the shafts.

The drum flange 5 has both a function of a conductive flange and a function of a gear that drives the transfer roller 15 and the charging roller 8.

In the image forming unit 1 having the configuration explained above, the charging roller 8 applied with bias voltage is brought into contact with the semiconductor layer 7. The charging roller 8 injects charges into the semiconductor layer 7. The surface of the photoconductive drum 2 is charged.

The laser oscillator 9 exposes the surface of the photoconductive drum 2 with an image that should be formed. An electrostatic image obtained in this way is developed by the developing device 10.

The transfer roller 15 applied with bias voltage acts on a developed toner image. The toner image is transferred onto the paper 14. A toner remaining on the surface of the photoconductive drum 2 without being transferred is removed by the cleaner 18 applied with a bias.

For example, in a hot and humid room, after a power supply for the MFP is turned off at night, moisture condensation of water vapor may occur in the inside of the MFP in the next morning. The moisture condensation may adhere to the surfaces of the drum flange 5, the gear member 26, the shaft 16, and the like.

The moisture condensation causes a fall in electric resistance on the surface of the gear member 26. A distance for insulation along the sides of the gear member without the grooves 31 is small. If the moisture condensation adheres to the sides of the gear member without the grooves 31, an undesired electric path is formed on the sides.

Since a distance for insulation along the surfaces is large, in the image forming apparatus according to this embodiment, the insulation is not broken even if the moisture condensation occurs on the surface of the gear member 26 or biases are applied to the charging roller 8 and the transfer roller 15, respectively. A failure of an image does not occur.

Since the distance for insulation along the surfaces is large, the nonconductive gear member 26 can prevent a leak between the shaft 16 of the charging roller 15 and the conductive drum flange 15.

As shown in FIGS. 4A and 4B and FIG. 5, the width in the axial direction of the nonconductive gear member 26 is smaller than the bearing width and the width of the gear teeth surface. Therefore, the distance for insulation along the surfaces can be increased.

With the image forming apparatus according to this embodiment, since a leak of an electric current does not occur, an electrostatic latent image is stably formed on the semiconductor layer 7 of the photoconductive drum 2.

The drum flange 5 is conductive. The drum flange 5 as a conductor and the shaft 16 as a conductor are arranged at a close distance from each other. Since the maximum diameter of the drum flange 5 is larger than the outer diameter of the aluminum pipe 6, the teeth tips of the gear teeth 22 as conductors are close to the outer circumferential surface of the shaft 16.

Thick paper and an OHP (Overhead Projector) sheet pass between the transfer roller 15 and the photoconductive drum 2. Bias voltage of several kilovolts is applied between the shaft 16 and the drum flange 5.

If the grooves 31 are not provided, since the drum flange 5 and the shaft 6 are arranged at a close distance from each other and the high bias voltage is applied thereto, it is likely that a leak occurs in the transmission structure shown in FIG. 2.

The nonconductive gear member 26 has width smaller than both the bearing width and the width of the surface of the gear teeth. Therefore, the image forming apparatus according to this embodiment can prevent the occurrence of a leak that is likely to be caused by the transmission structure shown in FIG. 2.

In this embodiment, synthetic resin is used for the conductive drum flange 5. It is also possible to use a metal material such as aluminum as the drum flange 5.

However, it is disadvantageous to use the metal material because cost required for molding of a metal drum flange is high.

In addition, a center hole of the metal drum flange and a conductive bushing as a bearing between the metal drum flange and the shaft 11 of the charging roller 8 are necessary.

The bushing excellent in slipperiness with respect to the shaft 11 is required in a portion where the center hole and the shaft 11 come into contact with each other and wear out. When the bushing is used, oil is also necessary. Reliability for certainty of grounding is deteriorated depending on the oil.

As measures against the wear, there is also a method of separately providing a sheet metal. If the sheet metal is provided, cost further increases.

On the other hand, in the image forming unit 1, it is possible to use the drum flange 5 of conductive synthetic resin while making it sure to insulate the charging roller 8 and the transfer roller 15. Therefore, the image forming apparatus according to this embodiment contributes to holding down an increase in cost of the MFP and the like.

In this embodiment, the material of the gear teeth provided on the outer circumference of the drum flange is synthetic resin. It is also possible to use metal such as aluminum for the gear teeth.

However, if the gear teeth are made of metal, the nonconductive gear member 26 on the transfer roller 15 side subjected to the driving force tends to wear out.

An amount of the wear of the gear member 26 is relatively smaller when the gear teeth of the drum flange 5 is made of resin than when the gear teeth of the drum flange 5 is made of metal.

In the image forming unit 1, it is possible to use the gear teeth of resin while making it sure to insulate the charging roller 8 ad the transfer roller 15. Therefore, with the image forming apparatus according to this embodiment, the gear member 26 on the transfer roller 15 side can be used for a long period.

Similarly, with the image forming apparatus according to this embodiment, the gear member provided in the charging roller 8 can also be used for a long period.

The path for insulation along the surfaces can be varied. Other forms of the gear member 26 are explained below with reference to FIGS. 6A and 6B to FIGS. 9A and 9B.

Figure 6B:
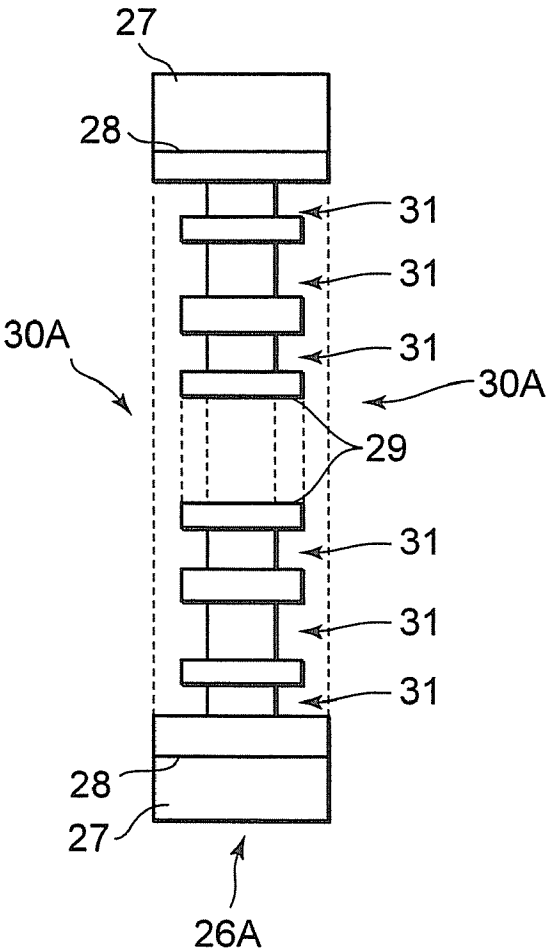
FIG. 6B is a schematic diagram of a longitudinal section along a WW line in FIG. 6A.
Figure 6A:
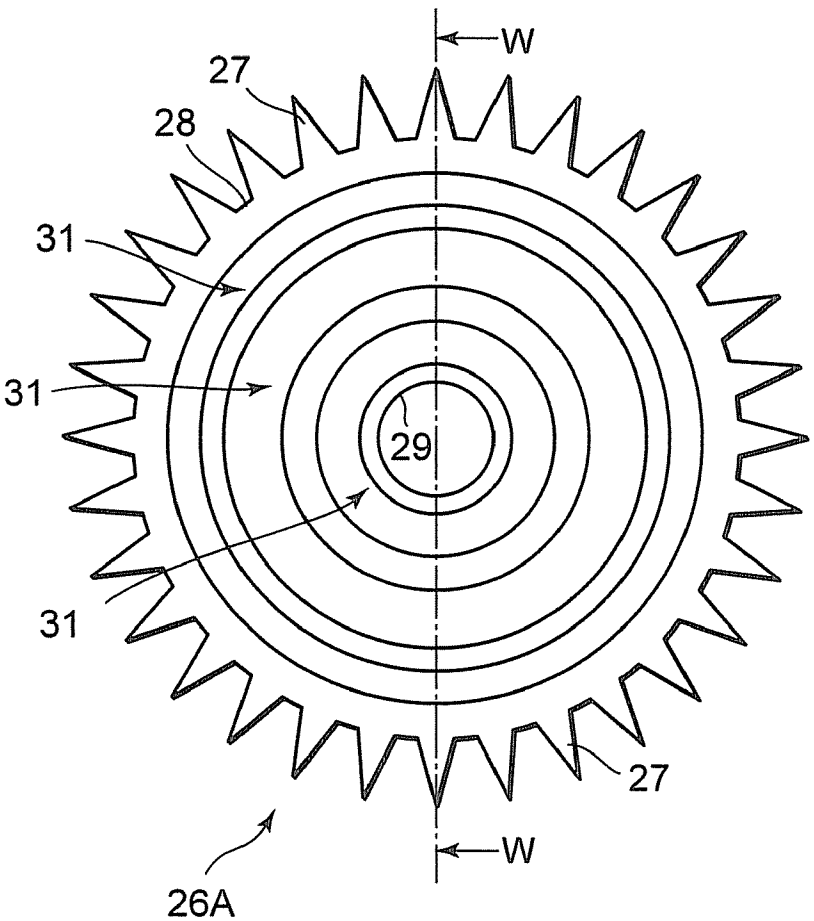
FIG. 6A is a side view of a gear member of a second form.

FIG. 6A is a side view of a gear member of a second form. FIG. 6B is a schematic diagram of a longitudinal section along a WW line in FIG. 6A.

Three grooves 31 of a concentric circular shape around the same axis are formed in each of sides of a gear member 26A. The three grooves 31 are formed in a radial direction of a diameter of the gear member 26A. An outer surface of the gear member 26A includes the outer circumferential surface 28, the bearing surface 29, and two sides 30A.

A distance for insulation along the surfaces from the outer circumferential surface of the shaft 16 of the transfer roller 15 to the teeth tips of the gear teeth 22 of the drum flange 5 is increased by groove walls and groove bottoms of the three grooves 31.

A nonconductive gear member substantially the same as the gear member 26A shown in FIGS. 6A and 6B may be attached to the shaft 11 of the charging roller 8.

The shape, the width, and the depth of the grooves can be varied.

Figure 7B:
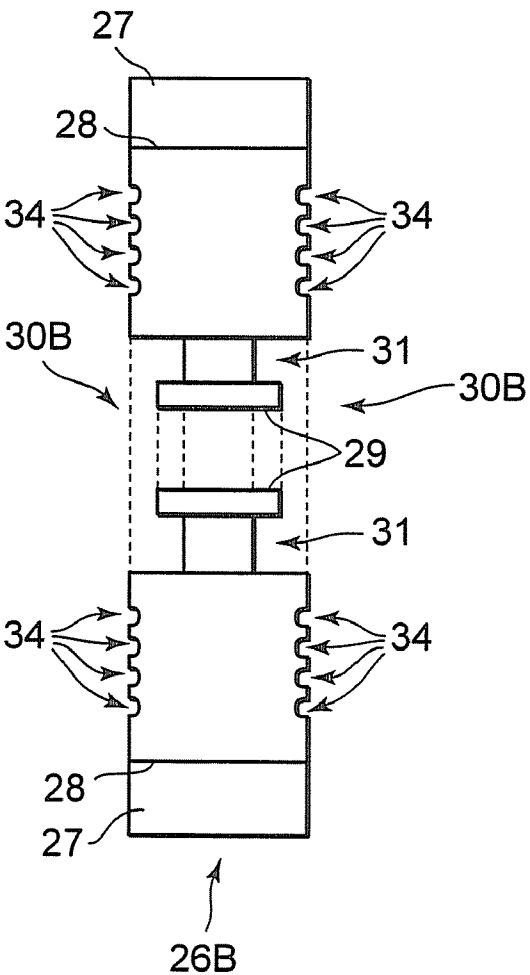
FIG. 7B is a schematic diagram of a longitudinal section along a WW line in FIG. 7A.
Figure 7A:
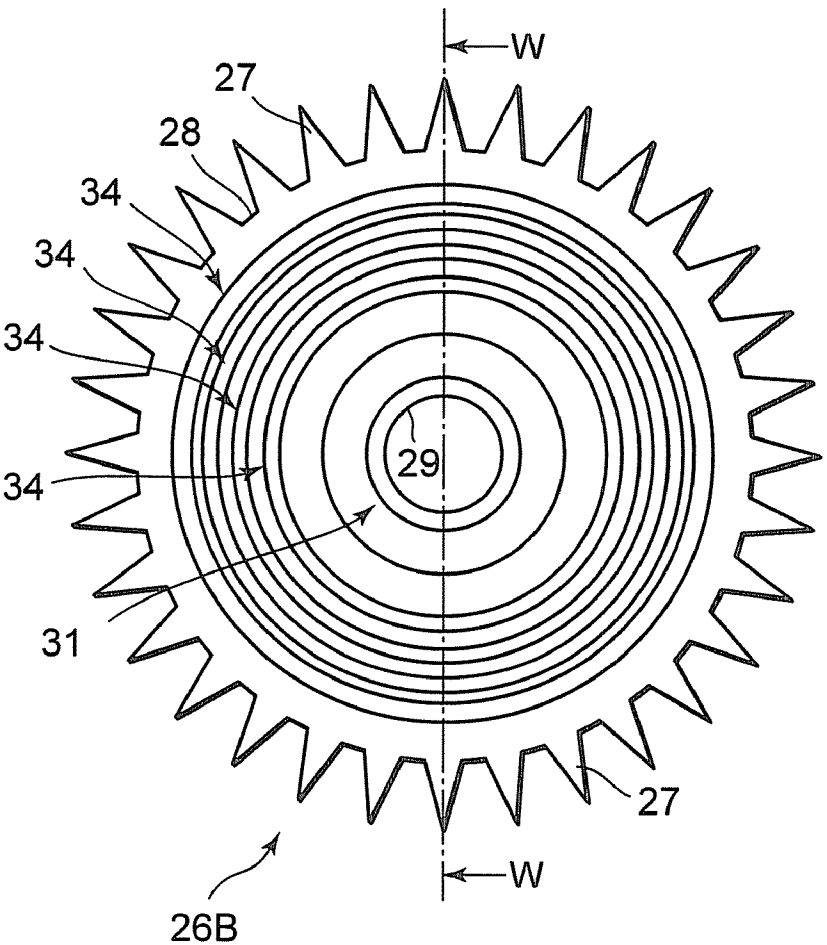
FIG. 7A is a side view of a gear member of a third form.

FIG. 7A is a side view of a gear member of a third form. FIG. 7B is a schematic diagram of a longitudinal section along a WW line in FIG. 7A.

One groove 31 around a shaft hole and separate four grooves 34 on an outer side of the groove 31 are formed in each of sides of a gear member 26B. The grooves 34 have U-shaped groove bottoms. The width of the grooves 34 is smaller than the width of the groove 31. The depth of the grooves 34 is smaller than the depth of the groove 31.

An outer surface of the gear member 26B includes the outer circumferential surface 28, the bearing surface 29, and two sides 30B.

A distance for insulation along the surfaces from the outer circumferential surface of the shaft 16 of the transfer roller 15 to the teeth tips of the gear teeth 22 of the drum flange 5 is increased by groove walls and a groove bottom of the groove 31 and groove walls and groove bottoms of the grooves 34.

A nonconductive gear member substantially the same as the gear member 26B shown in FIGS. 7A and 7B may be attached to the shaft 11 of the charging roller 8.

Protrusions having width larger than the gear width of the gear member may be formed on a side of the gear member.

Figure 8B:
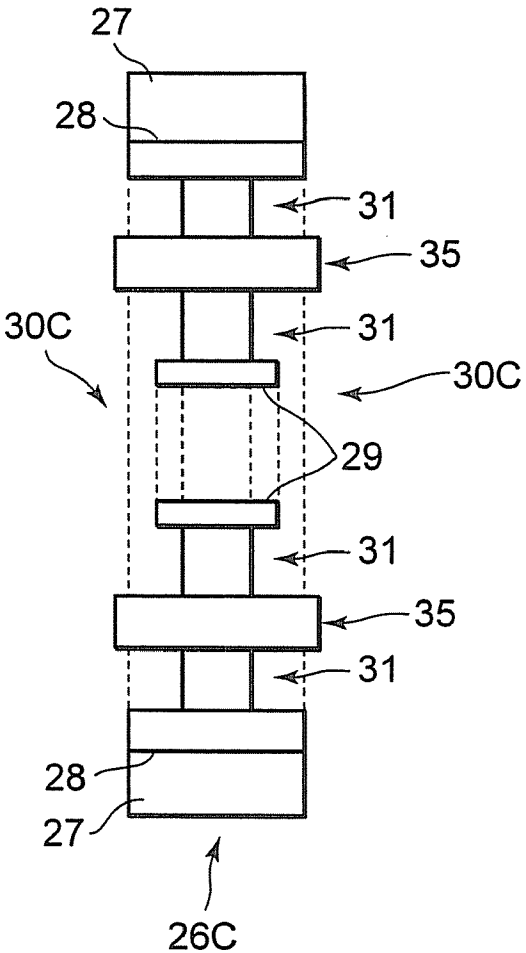
FIG. 8B is a schematic diagram of a longitudinal section along a WW line in FIG. 8A.
Figure 8A:
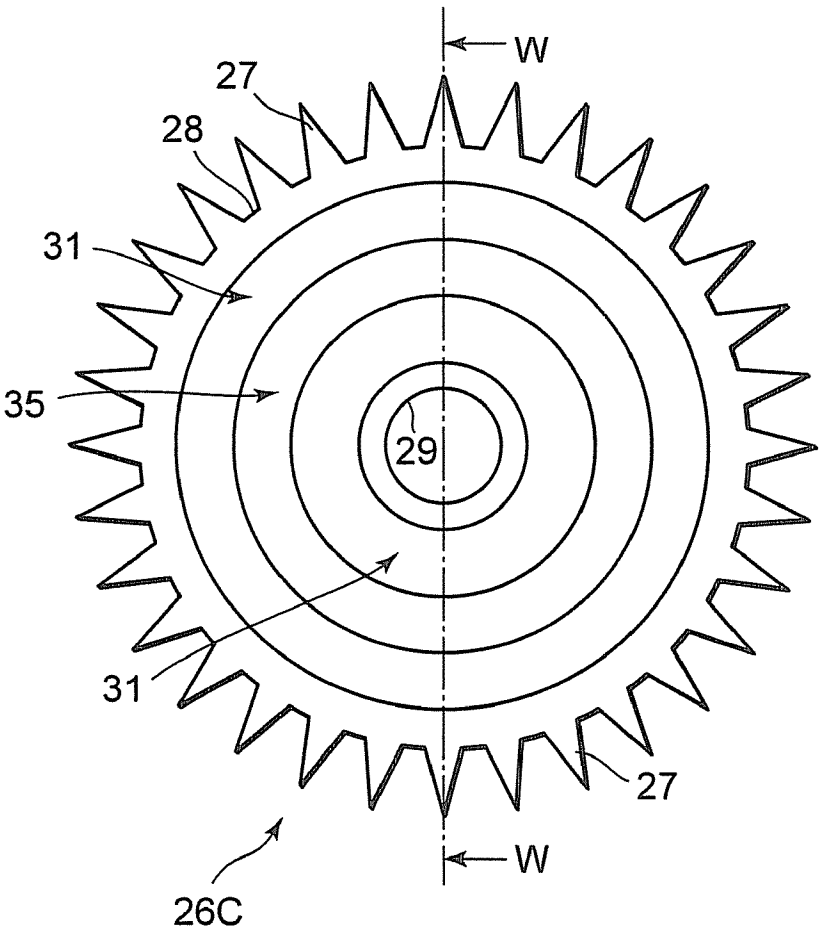
FIG. 8A is a side view of a gear member of a fourth form.

FIG. 8A is a side view of a gear member of a fourth form. FIG. 8B is a schematic diagram of a longitudinal section along a WW line in FIG. 8A.

A circumferential protrusion 35 that protrudes from each of sides of the gear member 26C to an end side in an axial direction thereof is formed on the side of the gear member 26C. An outer surface of the gear member 26C includes the outer circumferential surface 28, the bearing surface 29, and two sides 30C.

A distance for insulation along the surfaces from the outer circumferential surface of the shaft 16 of the transfer roller 15 to the teeth tips of the gear teeth 22 of the drum flange 5 is increased by a wall surface and an end face of the protrusion 35.

A nonconductive gear member substantially the same as the gear member 26C shown in FIGS. 8A and 8B may be attached to the shaft 11 of the charging roller 8.

The length of the projection may be different on the left and the right of the gear member 26C.

Figure 9B:
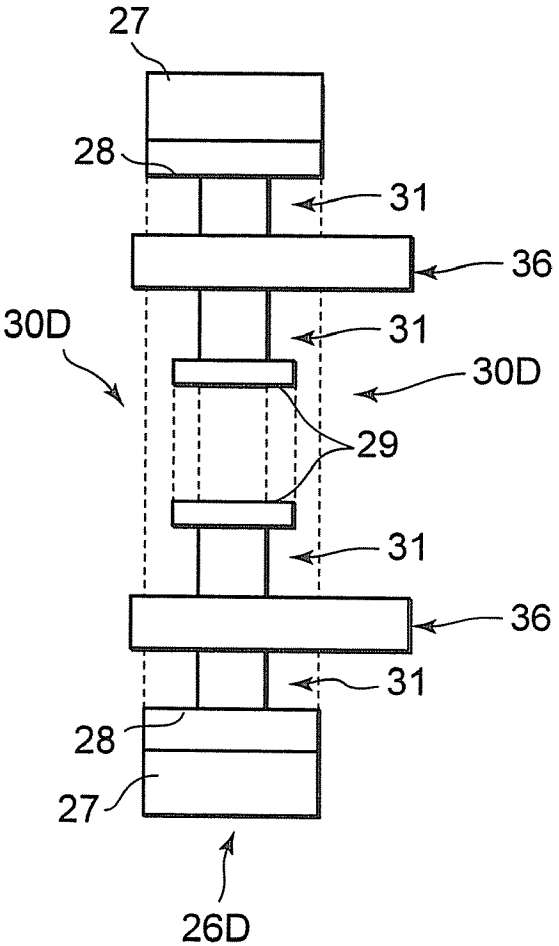
FIG. 9B is a schematic diagram of a longitudinal section along a WW line in FIG. 9A.
Figure 9A:
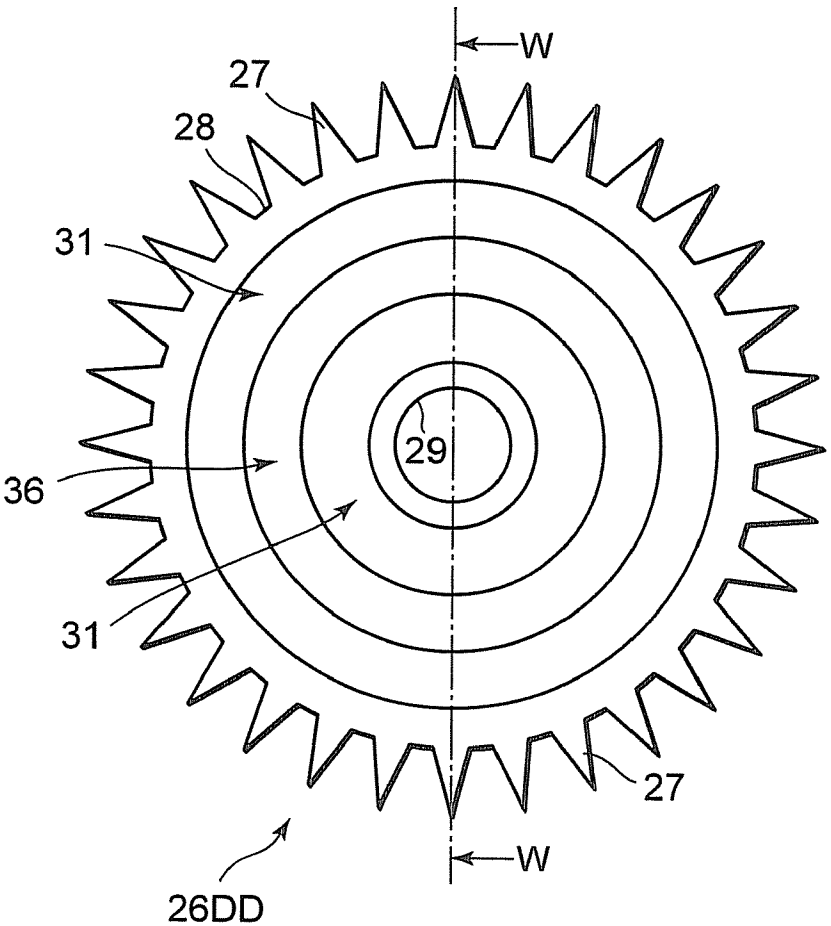
FIG. 9A is a side view of a gear member of a fifth form.

FIG. 9A is a side view of a gear member of a fifth form. FIG. 9B is a schematic diagram of a longitudinal section along a WW line in FIG. 9A.

One protrusion 36 that protrudes from each of sides of a gear member 26D to an end side in an axial direction thereof is formed on the side of the gear member 26D. The length of the protrusion 36 on the right side is larger than the length of the protrusion 36 on the left side.

The length of the protrusion 36 on the left side is determined such that the protrusion 36 does not come into contact with the right end of the elastic layer member 17 of the transfer roller 15 shown in FIG. 2.

A distance for insulation along the surfaces from the outer circumferential surface of the shaft 16 of the transfer roller 15 to the teeth tips of the gear teeth 22 of the drum flange 5 is increased by a wall surface and an end face of the protrusion 36.

A nonconductive gear member substantially the same as the gear member 26D shown in FIGS. 9A and 9B may be attached to the shaft 11 of the charging roller 8.

The image forming apparatus according to the embodiment is the MFP. However, the image forming apparatus according to the embodiment may be a printer or a copying machine.

In the embodiment, the grooves 31 have the groove bottoms. However, a V groove may be formed in each of the sides of the gear member 26. The insulation path is enlarged by a groove wall of the V groove as well.

The grooves 31 are the circumferential grooves. However, plural grooves having groove lengths smaller than circumferential length may be formed in the gear member 26. The grooves and a protrusion may be combined.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a photoconductive drum including a conductive cylindrical member and a photoconductive layer on an outer circumferential surface of the cylindrical member;

a transfer roller including a conductive shaft member that has an axis parallel to an axis of the cylindrical member of the photoconductive drum, and a contact charging member that is provided in an outward direction of the shaft member to transfer a developer image onto a recording medium;

a conductive drum flange that is provided at one end of the cylindrical member of the photoconductive drum, and on an outer circumferential surface of which plural first gear teeth are formed;

a driving unit that drives to rotate the drum flange; and a nonconductive gear member that is provided in the shaft member of the transfer roller to be opposed to the drum flange and has an outer circumferential surface on which plural second gear teeth, to which driving force is transmitted from the plural first gear teeth of the drum flange, are formed, a bearing surface that rotatably supports the shaft member, and two sides orthogonal to an axial direction of the shaft member and on at least one side of which a groove is formed.

2. The apparatus according to claim 1, wherein width of the groove is smaller than both width of the bearing surface of the gear member and width of the outer circumferential surface.

3. The apparatus according to claim 1, wherein an outer diameter of the drum flange including height of the plural first gear teeth is larger than an outer diameter of the cylindrical member of the photoconductive drum.

4. The apparatus according to claim 1, wherein width in the axial direction of a teeth row of the plural second gear teeth formed in the gear member is larger than width in the axial direction of a teeth row of the plural first gear teeth formed in the drum flange.

5. The apparatus according to claim 1, wherein plural grooves are formed in a radial direction of a diameter of the gear member in the side of the gear member.

6. The apparatus according to claim 1, wherein a protrusion that protrudes from the side to an end side in the axial direction is formed on the side of the gear member.

7. The apparatus according to claim 5, wherein a protrusion that protrudes from the side to an end side in the axial direction is formed on the side of the gear member.

8. An image forming apparatus comprising:

a photoconductive drum including a conductive cylindrical member and a photoconductive layer on an outer circumferential surface of the cylindrical member;

a charging roller including a conductive shaft member that has an axis parallel to an axis of the cylindrical member of the photoconductive drum, and a contact charging member that is provided in an outward direction of the shaft member to charge the photoconductive layer;

a conductive drum flange that is provided at one end of the cylindrical member of the photoconductive drum, and on an outer circumferential surface of which plural first gear teeth are formed;

a driving unit that drives to rotate the drum flange; and a nonconductive gear member that is provided in the shaft member of the charging roller to be opposed to the drum flange and has an outer circumferential surface on which plural second gear teeth, to which driving force is transmitted from the plural first gear teeth of the drum flange, are formed, a bearing surface that rotatably supports the shaft member, and two sides orthogonal to an axial direction of the shaft member and on at least one side of which a groove is formed.

9. The apparatus according to claim 8, wherein width of the groove is smaller than both width of the bearing surface of the gear member and width of the outer circumferential surface.

10. The apparatus according to claim 8, wherein an outer diameter of the drum flange including height of the plural first gear teeth is larger than an outer diameter of the cylindrical member of the photoconductive drum.

11. The apparatus according to claim 8, wherein width in the axial direction of a teeth row of the plural second gear teeth formed in the gear member is larger than width in the axial direction of a teeth row of the plural first gear teeth formed in the drum flange.

12. The apparatus according to claim 8, wherein plural grooves are formed in a radial direction of a diameter of the gear member in the side of the gear member.

13. The apparatus according to claim 8, wherein a protrusion that protrudes from the side to an end side in the axial direction is formed on the side of the gear member.

14. The apparatus according to claim 12, wherein a protrusion that protrudes from the side to an end side in the axial direction is formed on the side of the gear member.

15. An image forming apparatus comprising:

a photoconductive drum including a conductive cylindrical member and a photoconductive layer on an outer circumferential surface of the cylindrical member;

a roller including a conductive shaft member that has an axis parallel to an axis of the cylindrical member of the photoconductive drum, and a contact charging member that is provided in an outward direction of the shaft member;

a conductive drum flange that is provided at one end of the cylindrical member of the photoconductive drum, and on an outer circumferential surface of which plural first gear teeth are formed;

a driving unit that drives to rotate the drum flange; and a nonconductive gear member that is provided in the shaft member of the roller to be opposed to the drum flange and has an outer circumferential surface on which plural second gear teeth, to which driving force is transmitted from the plural first gear teeth of the drum flange, are formed, a bearing surface that rotatably supports the shaft member, and two sides orthogonal to an axial direction of the shaft member and on at least one side of which a groove is formed.

16. The apparatus according to claim 15, wherein width of the groove is smaller than both width of the bearing surface of the gear member and width of the outer circumferential surface.

17. The apparatus according to claim 15, wherein an outer diameter of the drum flange including height of the plural first gear teeth is larger than an outer diameter of the cylindrical member of the photoconductive drum.

18. The apparatus according to claim 15, wherein width in the axial direction of a teeth row of the plural second gear teeth formed in the gear member is larger than width in the axial direction of a teeth row of the plural first gear teeth formed in the drum flange.

19. The apparatus according to claim 15, wherein plural grooves are formed in a radial direction of a diameter of the gear member in the side of the gear member.

20. The apparatus according to claim 15, wherein a protrusion that protrudes from the side to an end side in the axial direction is formed on the side of the gear member.

21. A transfer roller comprising:

a conductive shaft member that has an axis parallel to an axis of a photoconductive drum, the photoconductive drum including a conductive cylindrical member, a photoconductive layer on an outer circumferential surface of the cylindrical member, and a conductive drum flange provided at one end of the cylindrical member and on an outer circumferential surface of which plural first gear teeth are formed;

a contact charging member provided in an outward direction of the shaft member to transfer a developer image onto a recording medium; and a nonconductive gear member provided in the shaft member to be opposed to the drum flange and has an outer circumferential surface on which plural second gear teeth, to which driving force is transmitted from the plural first gear teeth of the drum flange, are formed, a bearing surface that rotatably supports the shaft member, and two sides orthogonal to an axial direction of the shaft member and on at least one side of which a groove is formed.

* * * * *